United States Patent [19]

Bills

[11] 3,984,136

[45] Oct. 5, 1976

[54] LOCK FOR SLIDING DOORS

[76] Inventor: Marius W. Bills, 16220 Schoolcraft, Detroit, Mich. 48227

[22] Filed: Oct. 1, 1975

[21] Appl. No.: 618,621

[52] U.S. Cl. ..... 292/182; 292/62; 292/DIG. 46

[51] Int. Cl.[2] ..... E05C 1/06

[58] Field of Search ..... 292/58, 62, 153, 169 R, 292/193, 181, 182, 210, DIG. 46; 74/569; 49/449

[56] References Cited

UNITED STATES PATENTS

| | | | |
|---|---|---|---|
| 835,333 | 11/1906 | Tauveron | 292/182 |
| 1,194,022 | 8/1916 | Hudson | 292/182 |
| 2,513,483 | 7/1950 | Hempfling | 292/182 |
| 2,699,204 | 1/1955 | Davis | 292/DIG. 46 X |
| 2,810,824 | 10/1957 | Kaufman | 292/182 X |
| 2,887,735 | 5/1959 | Coffey | 292/182 X |

*Primary Examiner*—Roy D. Frazier
*Assistant Examiner*—William E. Lyddane
*Attorney, Agent, or Firm*—Barnes, Kisselle, Raisch & Choate

[57] ABSTRACT

A sliding door comprising a first door, a second door mounted for sliding movement relative to the first door, and a lock assembly mounted on the second door. The lock assembly comprises a housing having an inner wall and an outer wall and side walls. The housing is mounted on the second door with the one side wall engaging the frame of the second door, the inner wall has an opening therein and a plunger is movable through the opening. The first door has at least one opening therein engageable by the plunger. The plunger is rotatably mounted within the housing for movement axially and rotatably. An annular surface is provided concentrically with the plunger and is movable therewith. A cam is supported within the housing for movement into and out of engagement with the annular surface such that when the cam is moved into engagement with the annular surface, the plunger is moved axially through the outer wall into the opening in the front door. A handle is associated with the cam externally of the housing for manipulating the cam.

17 Claims, 8 Drawing Figures

LOCK FOR SLIDING DOORS

This invention relates to sliding doors and particularly to locks for sliding doors.

BACKGROUND OF THE INVENTION

In sliding doors for homes and the like, it is common to provide a hand-manipulated latch as a lock. However, such a latch does not provide sufficient security and, therefore, it has heretofore been suggested that other auxiliary locks be provided.

Among the objects of the invention are to provide a lock for sliding doors which is low in cost, easy to manufacture, easily installed, effectively locks the sliding door, prevents lifting of the door off its track and is subject to minimal tampering.

SUMMARY OF THE INVENTION

In accordance with the invention, the lock comprises a housing having an inner wall and an outer wall and side walls. The inner wall has an opening therein and a plunger is movable through the opening for engaging an opening in a door. The plunger is mounted within the housing for movement axially and rotatably and includes an annular surface concentric with the plunger and movable therewith. A cam is supported within said housing for movement into and out of engagement with the annular surface such that when the cam is moved into engagement with the annular surface, the plunger is moved axially through the outer wall into the opening in the first door. Means are associated with the cam and extend externally of said housing to provide a handle for manipulating the cam.

DESCRIPTION

Figure 1:
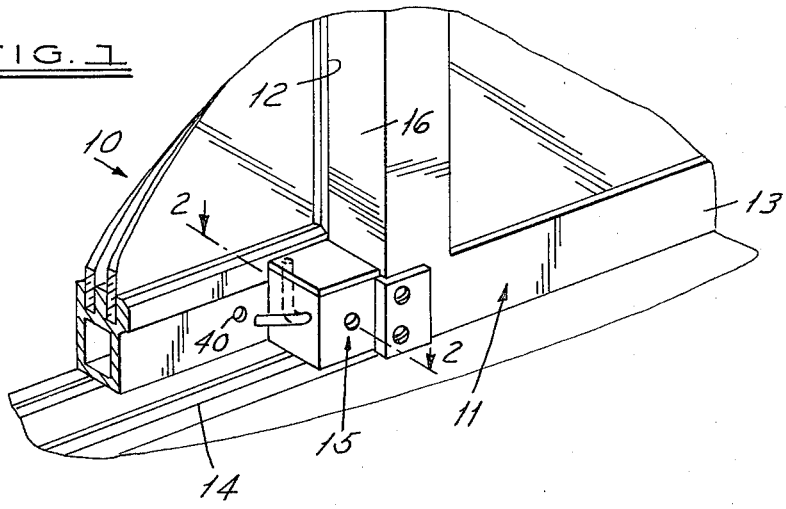
FIG. 1 is a fragmentary perspective view of a sliding door construction embodying the invention.
Figure 2:
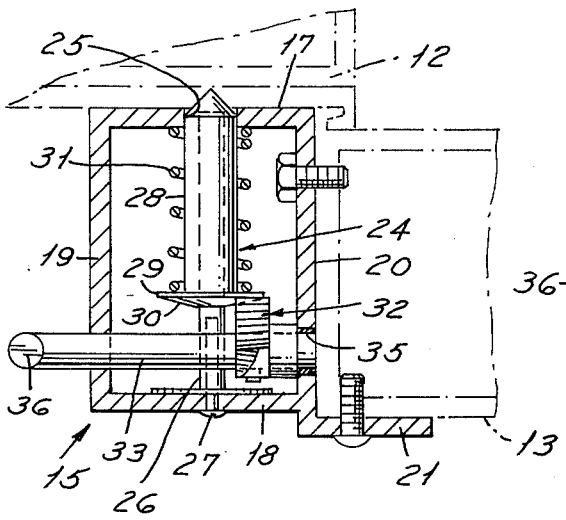
FIG. 2 is a fragmentary sectional view on an enlarged scale taken along the line 2—2 of FIGS. 1 and 4, parts being broken away.
Figure 3:
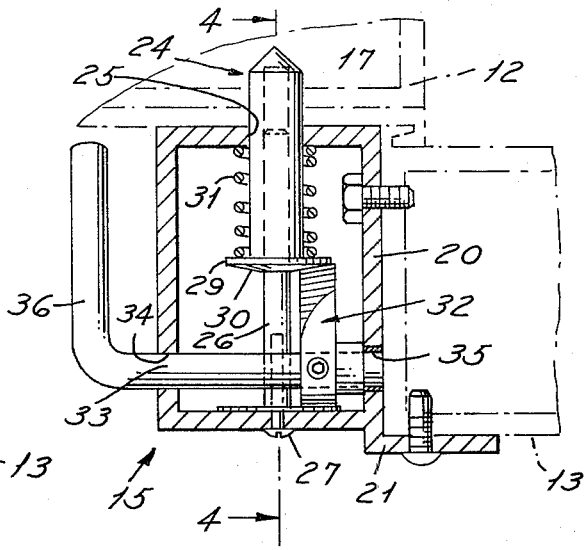
FIG. 3 is a sectional view similar to FIG. 2 showing the parts in a different operative position.

Referring to FIG. 1, the invention is adapted to be used with sliding doors of conventional construction which include a door 10 and a sliding door 11 each of which has frame 12,13, the door 11 being movable relative to the door 10 along a track 14. A lock 15 is mounted on the side wall 16 of the frame 13 and includes a housing having an inner wall 17, an outer wall 18 and side walls 19,20 all of which are formed in a single extrusion from aluminum or the like. The housing further includes a flange 21 that is adapted to engage the outer surface of the frame 13. Top and bottom walls 22,23 are fastened to the housing as by adhesives or the like. Flange 21 may be adjustable relative to the housing as shown in my copending application Ser. No. 618,620 filed Oct. 1, 1975 titled Lock For Sliding Doors, filed concurrently herewith.

The lock further includes a tubular plunger 24 that is movable axially through an opening 25 in inner wall 17 having a configuration which is preferably circular and conforms with the periphery of the plunger 24. The plunger 24 slidably engages a shaft 26 for rotatable and axial movement on shaft 26 which is held in position of the outer wall 18 by a screw 27 threaded therein. The plunger 24 includes an enlarged inner end portion 28 which has a washer 29 formed integrally therewith and having an inclined surface 30 as presently described. A spring 31 is interposed between the inner surface of the inner wall 17 and the washer 30 to yieldingly urge the plunger outwardly.

A cam 32 is adapted to be moved toward and away from the washer 29 to in turn move the plunger 24 axially outwardly or permitted to be returned axially inwardly by the spring 31. The cam is mounted on a shaft 33 that is journalled in openings 34, 35 in the side walls 19, 20 and includes a right-angle portion 36 forming a manipulating handle. Opening 35 is preferably provided with a low friction bushing to facilitate rotation of shaft 33.

The cam 32 includes curved and inclined surfaces **32*a*, 32*b* which terminate in an apex 32*c* inclined to the axis of shaft 33. The inclination or angle of surface 32*a* and apex 32*c* with respect to shaft 33 is substantially equal to the angle of surface 30 to the axis of plunger 24. The axis of the shaft 33 is spaced from the axis of movement of the plunger 24** and at a right angle thereto.

By manipulating the handle, the plunger 24 can be moved axially into engagement with one or more openings 40 in the first door 10 to lock the sliding door 11 either in closed or partly open position.

Figure 4:
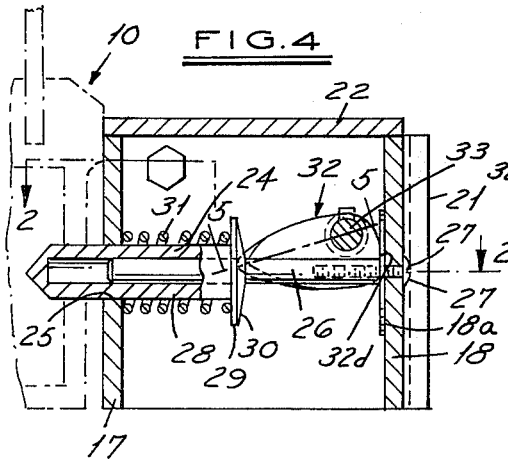
FIG. 4 is a sectional view taken along the line 4—4 in FIG. 3.
Figure 6:
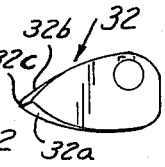
FIG. 6 is a fragmentary view of a part of FIG. 4.
Figure 5:
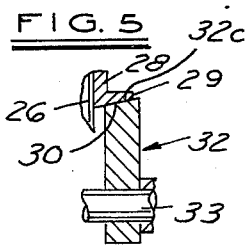
FIG. 5 is a fragmentary sectional view taken along the line 5—5 in FIG. 4.
Figure 7:
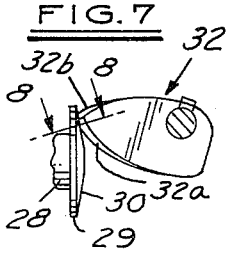
FIG. 7 is a fragmentary sectional view of a portion of FIG. 4, showing the parts in a different operative position.
Figure 8:
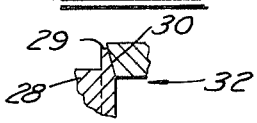
FIG. 8 is a fragmentary sectional view taken along the line 8—8 in FIG. 7.

When the handle is manipulated, initially the surface **32*a* engages surface 30 in the position shown in FIGS. 7 and 8. Upon further rotation, cam 32 moves over center so that apex 32*c* assumes the position shown in FIG. 4 with the surface 32*b* engaging the surface 30 and surface 32*d* engaging a wear plate or washer 18*a* on wall 18 to stop the movement of cam 32 and lock it in position. Plate 18*a* is interposed between the end of shaft 26 and wall 18*a***.

The arrangement of the cam and its engagement with the periphery of the surface 30 is such that upon each manipulation of the cam to move the plunger axially inwardly or outwardly, the washer 29 and in turn the plunger 24 are also rotated. In this manner, wear on the surface 30 is minimized.

I claim:

1. In a sliding door, the combination comprising
a first door having a frame,
a second door having a frame,
means for mounting said second door for sliding movement relative to said first door,
and a lock assembly mounted on said second door,
said lock assembly comprising a housing having an inner wall, an outer wall and side walls,
means for mounting said housing on the said second door with the one side wall engaging the frame of the second door,
said inner wall having an opening therein,
a plunger movable through said opening,
said first door having at least one opening therein engageable with said plunger, means for rotatably mounting said plunger within said housing for movement axially and rotatably, means defining an annular surface concentric with said plunger and movable therewith, a cam, means for supporting said cam within said housing for movement into and out of engagement with the annular surface such that when the cam is moved into engagement with the annular surface, the plunger is rotated and is moved axially through the outer wall into the opening in the first door, and means associated with said cam and extending externally of said housing to provide a handle for manipulating said cam.

2. The combination set forth in claim 1 including means yieldingly urging said member having the annular surface thereof and in turn said plunger toward said cam.

3. The combination set forth in claim 1 wherein said means rotatably mounting said plunger comprises a shaft extending from the outer wall toward the inner wall and rotatably supporting said plunger.

4. The combination set forth in claim 1 wherein the cam is mounted about an axis transverse and spaced from the axis of movement of the plunger.

5. The combination set forth in claim 4 wherein the cam includes an end surface movable from a position to one side of axis of the annular surface to a position at the other side of the axis of the annular surface.

6. The combination set forth in claim 5 including arcuate surfaces on said cam terminating in said end surface.

7. In a lock for a sliding door, a housing having an inner wall and an outer wall and side walls, said inner wall having an opening therein, a plunger movable through said opening, means for rotatably mounting said plunger within said housing for movement axially and rotatably, means defining an annular surface concentric with said plunger and movable therewith, a cam, means for supporting said cam within said housing for movement into and out of engagement with the annular surface such that when the cam is moved into engagement with the annular surface, the plunger is rotated and is moved axially through the inner wall, and means associated with said cam and extending externally of said housing to provide a handle for manipulating said cam.

8. The combination set forth in claim 7 including means yieldingly urging said member having the annular surface thereof and in turn said plunger toward said cam.

9. The combination set forth in claim 10 wherein said means rotatably mounting said plunger comprises a shaft extending from the outer wall toward the inner wall and rotatably supporting said plunger.

10. The combination set forth in claim 7 wherein the cam is mounted about an axis transverse and spaced from the axis of movement of the plunger.

11. The combination set forth in claim 7 wherein the cam includes an end surface movable from a position to one side of the annular surface to a position at the other side of the annular surface.

12. The combination set forth in claim 11 including arcuate surfaces on said cam terminating in said end surface.

13. In a lock for a sliding door, a housing comprising an extrusion having an inner wall and an outer wall and side walls, said inner wall having an opening therein, a plunger movable through said opening, means for rotatably mounting said plunger within said housing for movement axially and rotatably, means defining an annular surface concentric with said plunger and movable therewith, a cam, means for supporting said cam within said housing for movement into and out of engagement with the annular surface such that when the cam is moved into engagement with the annular surface, the plunger is rotated and is moved axially through the inner wall, means yieldingly urging said member having the annular surface thereof and in turn said plunger toward said cam, and means associated with said cam and extending externally of said housing to provide a handle for manipulating said cam.

14. The combination set forth in claim 13 wherein said means rotatably mounting said plunger comprises a shaft extending from the outer wall toward the inner wall and rotatably supporting said plunger.

15. The combination set forth in claim 13 wherein the cam is mounted about an axis transverse and spaced from the axis of movement of the plunger.

16. The combination set forth in claim 13 wherein the cam includes an end surface movable from a position to one side of the annular surface to a position at the other side of the annular surface.

17. The combination set forth in claim 16 including arcuate surfaces on said cam terminating in said end surface.

* * * * *